US009243360B2

(12) United States Patent
Cole et al.

(10) Patent No.: US 9,243,360 B2
(45) Date of Patent: Jan. 26, 2016

(54) IMPELLER FOR A WASHING MACHINE APPLIANCE

(71) Applicant: General Electric Company, Schenectady, NY (US)

(72) Inventors: Lucius Levon Cole, Louisville, KY (US); David Scott Dunn, Smithfield, KY (US)

(73) Assignee: General Electric Company, Schenectady, NY (US)

( * ) Notice: Subject to any disclaimer, the term of this patent is extended or adjusted under 35 U.S.C. 154(b) by 363 days.

(21) Appl. No.: 13/736,321

(22) Filed: Jan. 8, 2013

(65) Prior Publication Data

US 2014/0190217 A1 Jul. 10, 2014

(51) Int. Cl.

| | |
|---|---|
| ***D06F 17/06*** | (2006.01) |
| ***D06F 17/10*** | (2006.01) |
| ***D06F 21/06*** | (2006.01) |

(52) U.S. Cl.

CPC ..... *D06F 17/06* (2013.01); *D06F 17/10* (2013.01); *D06F 21/06* (2013.01); *Y10T 29/49316* (2015.01)

(58) Field of Classification Search

CPC ..... D06F 17/06; D06F 17/10; D06F 21/06; Y10T 29/49316

USPC ..... 68/133, 134

See application file for complete search history.

(56) References Cited

U.S. PATENT DOCUMENTS

| | | | | |
|---|---|---|---|---|
| 1,506,783 | A * | 9/1924 | Snyder | 68/133 |
| 1,866,779 | A * | 7/1932 | Snyder | 8/159 |
| 2,334,859 | A * | 11/1943 | Beattie | 68/134 |
| 2,356,353 | A * | 8/1944 | Rocke | 68/134 |
| 2,565,056 | A * | 8/1951 | Whitlock | 68/133 |
| 4,494,390 | A * | 1/1985 | Hayashi et al. | 68/23.7 |
| 5,727,403 | A * | 3/1998 | Na | 68/133 |
| 5,878,602 | A * | 3/1999 | Kovich et al. | 68/134 |
| 7,506,525 | B2 | 3/2009 | La Belle et al. | |
| 2003/0200774 | A1 * | 10/2003 | Kim et al. | 68/133 |
| 2006/0162094 | A1 * | 7/2006 | La Belle et al. | 8/159 |
| 2008/0141466 | A1 * | 6/2008 | Leidig et al. | 8/159 |
| 2011/0168217 | A1 * | 7/2011 | Neff et al. | 134/201 |

FOREIGN PATENT DOCUMENTS

| | | |
|---|---|---|
| KR | 20030060407 | 7/2003 |

* cited by examiner

*Primary Examiner* — Joseph L Perrin
(74) *Attorney, Agent, or Firm* — Dority & Manning, P.A.

(57) ABSTRACT

An impeller for a washing machine appliance is provided. The impeller includes a stamped plate that is rotatable about an axis of rotation. The stamped plate also defines an opening at the axis of rotation. A mounting insert is received within the opening of the stamped plate in order to fix the mounting insert to the stamped plate.

14 Claims, 5 Drawing Sheets

IMPELLER FOR A WASHING MACHINE APPLIANCE

FIELD OF THE INVENTION

The present subject matter relates generally to washing machine appliances and impellers for the same.

BACKGROUND OF THE INVENTION

A washing machine appliance generally includes a cabinet with a wash tub mounted therein. The wash tub is configured for containing wash fluid during operation of the washing machine appliance. A wash basket is rotatably mounted within the wash tub. In vertical axis washing machine appliances, an agitating element, such as an impeller, is generally mounted at a bottom of the wash basket for agitating articles or churning wash fluid within the wash basket during operation of the washing machine appliance.

Impellers are generally constructed from an injected molded plastic. In higher end washing machine appliances, stainless steel covers are mounted to the injected molded components to improve the impeller's appearance. However, such covers can add to the cost of the impeller and washing machine appliance and can also add to the total assembly time need to produce the impeller and washing machine appliance. In particular, such designs can require otherwise unnecessary fasteners to secure the impeller's components together and can also consume valuable assembly time in securing the components together.

Accordingly, an impeller for a washing machine appliance with features for reducing a cost of the impeller and assembly time for the impeller would be useful. Further, an impeller for washing machine appliance that does not includes stainless steel covers mounted thereto would be useful.

BRIEF DESCRIPTION OF THE INVENTION

The present subject matter provides an impeller for a washing machine appliance. The impeller includes a stamped plate that is rotatable about an axis of rotation. The stamped plate also defines an opening at the axis of rotation. A mounting insert is received within the opening of the stamped plate in order to fix the mounting insert to the stamped plate. Additional aspects and advantages of the invention will be set forth in part in the following description, or may be apparent from the description, or may be learned through practice of the invention.

In a first exemplary embodiment, an impeller for a washing machine appliance is provided. The impeller is rotatable about an axis of rotation. The impeller defines an axial direction and a radial direction. The impeller includes a stamped plate that has a top surface and a bottom surface positioned opposite the top surface. The stamped plate also has a plurality of agitators that extend longitudinally along the radial direction and also project away from the top surface of the stamped plate along the axial direction. The stamped plate also defines an opening at the axis of rotation. A mounting insert has an upper surface, a lower surface, and a sidewall that extends between the upper surface and the lower surface. The sidewall of the mounting insert is received within the opening of the stamped plate in order to fix the mounting insert to the stamped plate. The mounting insert defines a cavity. The mounting insert also defines an inlet on the lower surface of the mounting insert that provides access to the cavity of the mounting insert.

In a second exemplary embodiment, a vertical axis washing machine appliance is provided. The vertical axis washing machine appliance includes a cabinet, a wash tub received within the cabinet, and a wash basket rotatably mounted within the wash tub. The wash basket extends between a top portion and a bottom portion. An impeller is mounted within the wash basket adjacent the bottom portion of the wash basket. The impeller is rotatable about an axis of rotation relative to the wash tub and the wash basket. The impeller defines an axial direction and a radial direction. The impeller includes a stamped plate having a top surface and a bottom surface positioned opposite the top surface. The stamped plate has a plurality of agitators that extend longitudinally along the radial direction and also project away from the top surface of said stamped plate along the axial direction. The stamped plate also defines an opening at the axis of rotation. A mounting insert has an upper surface, a lower surface, and a sidewall that extends between the upper surface and the lower surface. The sidewall of the mounting insert is received within the opening of the stamped plate in order to fix the mounting insert to the stamped plate. The mounting insert defines a cavity. The mounting insert also defines an inlet on the lower surface of the mounting insert that provides access to the cavity of the mounting insert.

In a third exemplary embodiment, a method for manufacturing an impeller for a washing machine appliance is provided. The method includes providing a sheet of material, stamping the sheet of material in order to form a stamped plate, rolling edges of the stamped plate, punching an opening on the stamped plate, and fixing a mounting insert within the opening of the stamped plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 2, an agitation element is mounted within a wash basket of the washing machine appliance.

In FIG. 3, a mounting insert according to an exemplary embodiment of the present subject matter is mounted within an opening of a stamped plate according to an exemplary embodiment of the present subject matter.

DETAILED DESCRIPTION

Figure 1:
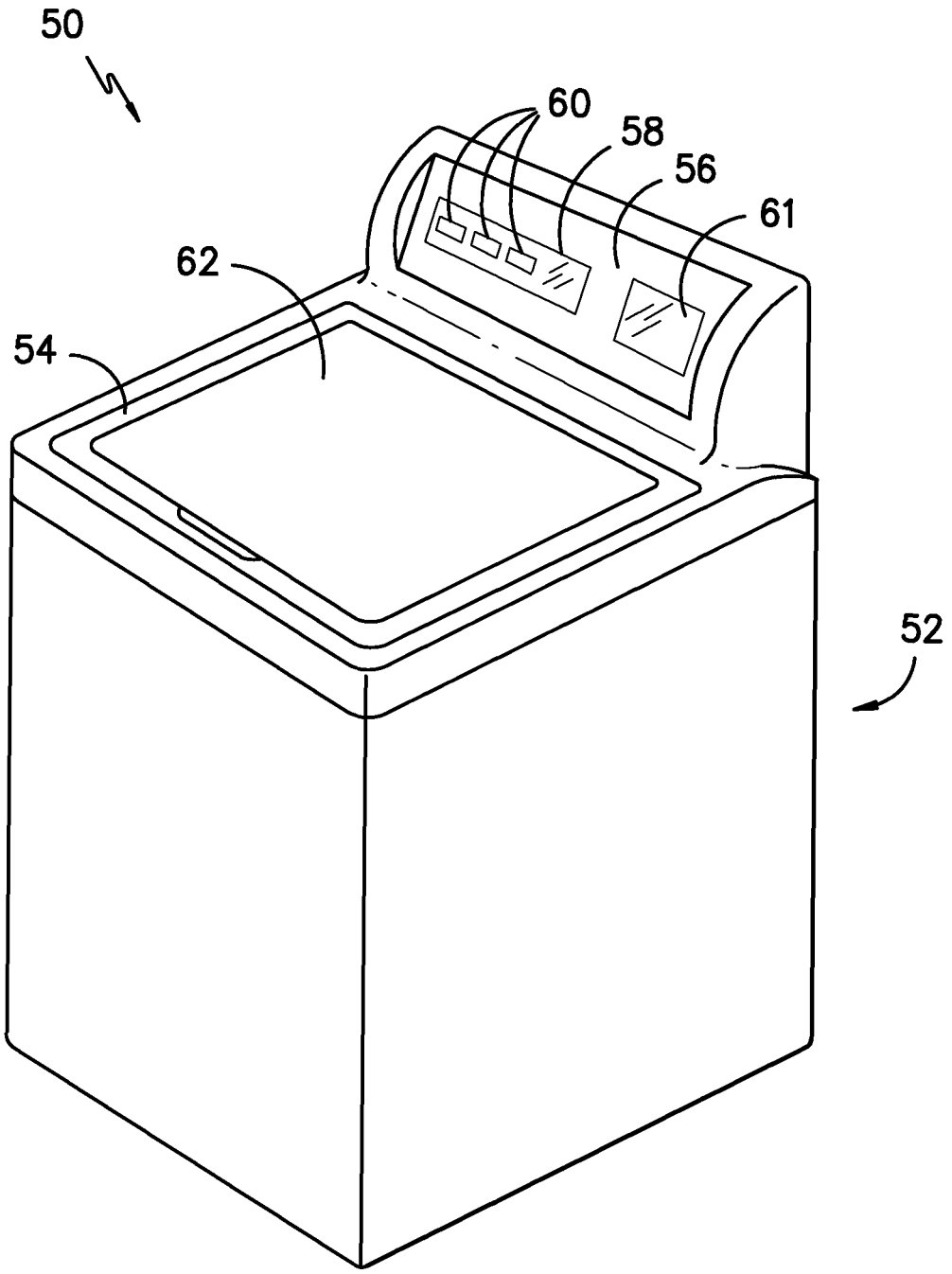
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a vertical axis washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 48 indicates selected features, a countdown timer, and/or other items of interest to machine users. A lid 62 is mounted to cover 54 and is rotatable about a hinge (not shown) between an open position (not shown) facilitating access to wash tub 64 (FIG. 2) located within cabinet 52 and a closed position (shown in FIG. 1) forming an enclosure over wash tub 64.

Figure 2:
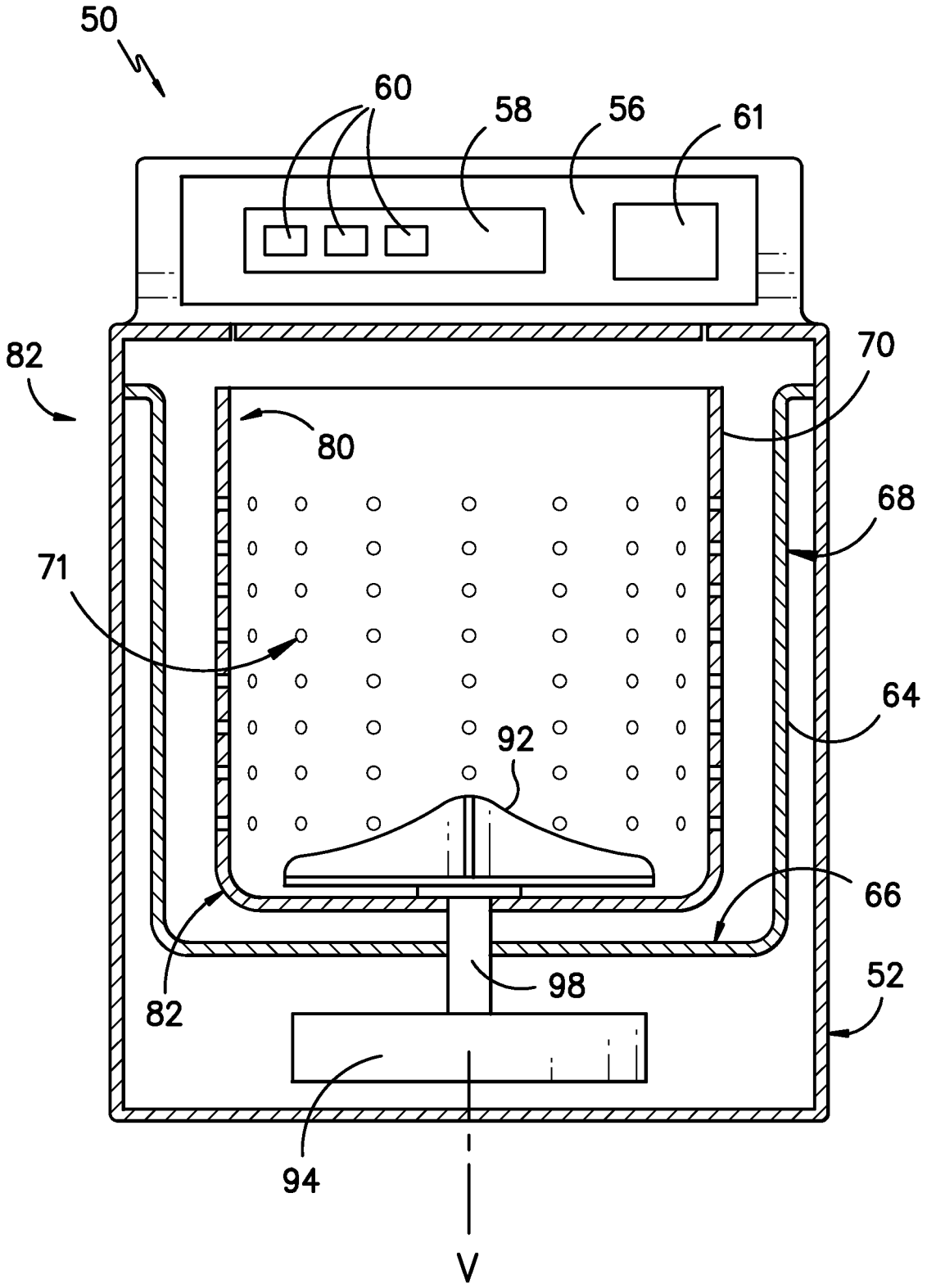
FIG. 2 illustrates a section view of the washing machine appliance of FIG. 1.

FIG. 2 provides a partial, cross-sectional view of washing machine appliance 50. As may be seen in FIG. 2, wash tub 64 includes a bottom wall 66 and a sidewall 68. A wash basket 70 is rotatably mounted within wash tub 64. In particular, wash basket 70 is rotatable about a vertical axis V. Wash basket 70 extends between a bottom portion 80 and a top portion 82. A pump assembly (not shown) is located beneath tub 64 and wash basket 70 for gravity assisted flow when draining wash tub 64. Wash basket 70 includes a plurality of perforations 71 therein to facilitate fluid communication between an interior of wash basket 70 and wash tub 64.

An agitation element 92, shown as an impeller in FIG. 2, is disposed in wash basket 70 to impart an oscillatory motion to articles and liquid in wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Wash basket 70 and agitation element 92 are driven by a pancake motor 94. As motor output shaft 98 is rotated, wash basket 70 and agitation element 92 are operated for rotatable movement within wash tub 64, e.g., about vertical axis V. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a controller or processing device (not shown), that is operatively coupled to the user interface input located on washing machine backsplash 56 (shown in FIG. 1) for user manipulation to select washing machine cycles and features. In response to user manipulation of the user interface input, the controller operates the various components of washing machine appliance 50 to execute selected machine cycles and features.

In an illustrative embodiment, laundry items are loaded into wash basket 70, and washing operation is initiated through operator manipulation of control input selectors 60. Wash tub 64 is filled with water and mixed with detergent to form a wash fluid. One or more valves (not shown) can be controlled by washing machine appliance 50 to provide for filling wash tub 64 to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 is moved back and forth in an oscillatory motion.

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds.

Figure 3:
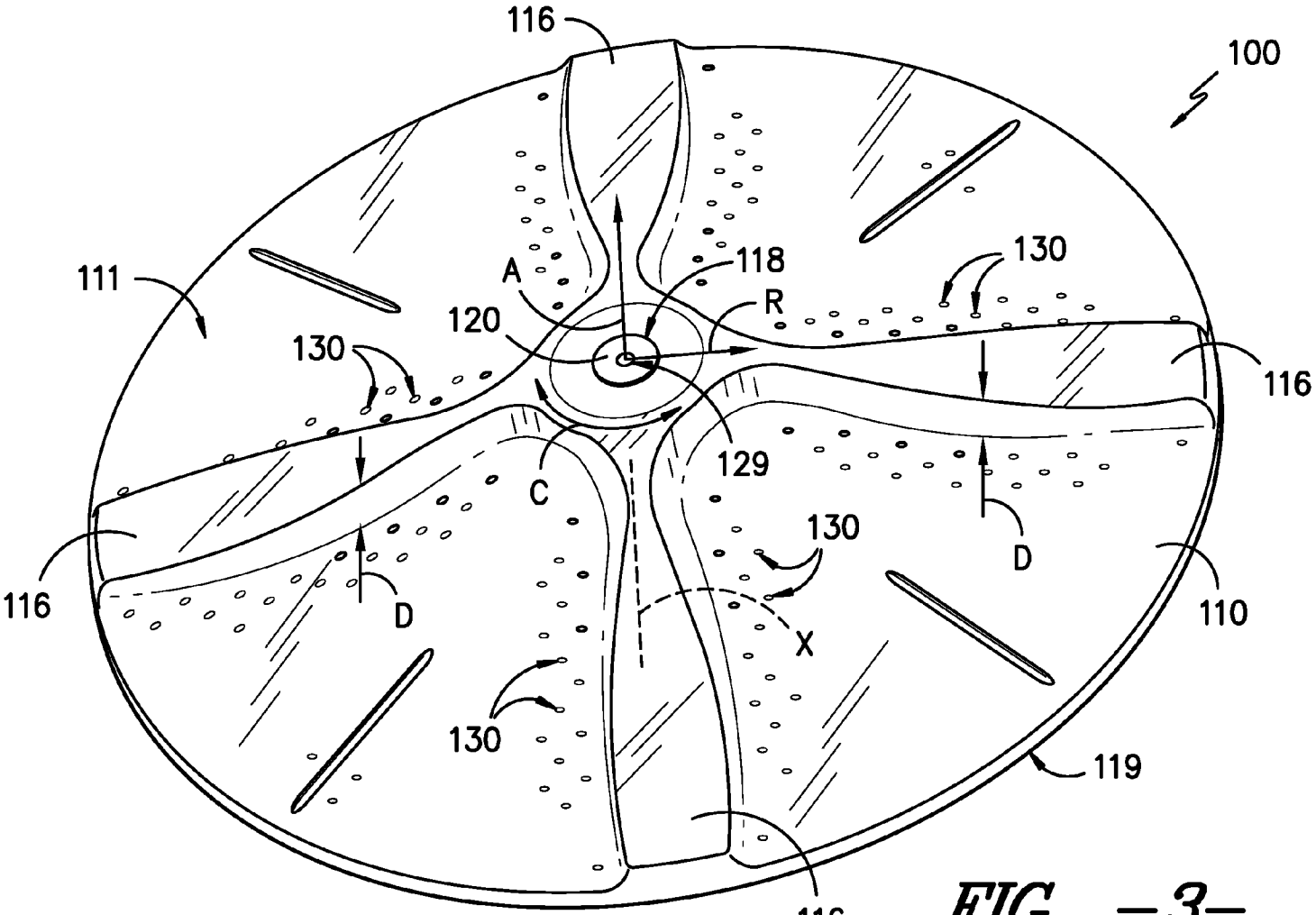
FIG. 3 is a top, perspective view of an impeller according to an exemplary embodiment of the present subject matter.
Figure 4:
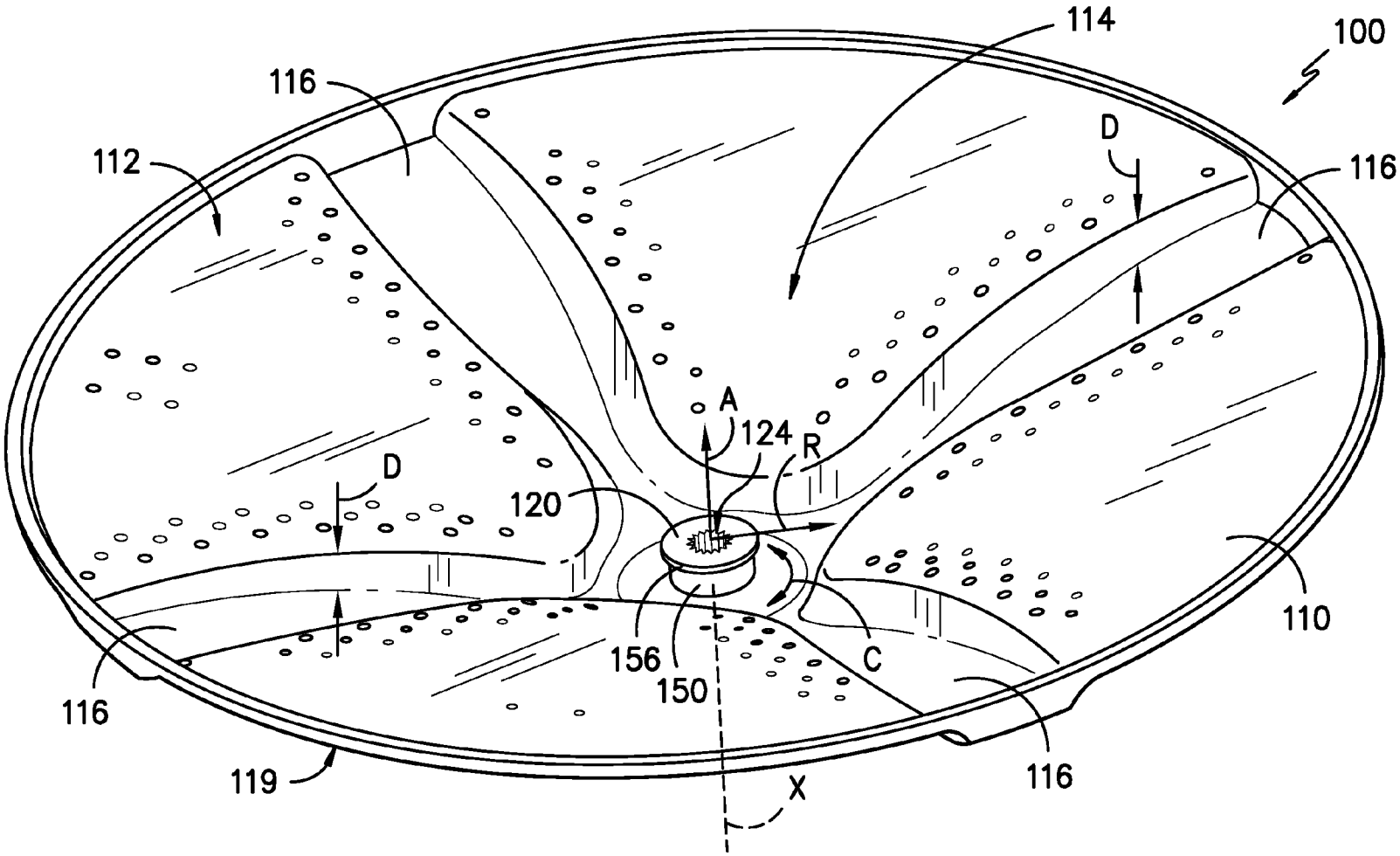
FIG. 4 provides a bottom, perspective view of the impeller of FIG. 3.

FIG. 3 is a top, perspective view of an impeller 100 according to an exemplary embodiment of the present subject matter. FIG. 4 provides a bottom, perspective view of impeller 100. Impeller 100 may, e.g., be mounted within washing machine appliance 50 (FIG. 2) for use as agitation element 92 or in any other suitable washing machine appliance. Thus, as discussed above, impeller 100 can agitate articles within wash basket 70 during operation of washing machine appliance 50 in order to assist with cleaning of such articles. As discussed in greater detail below, impeller 100 includes, e.g., features for reducing cost of and/or reducing assembly time for washing machine appliance 50 relative to other agitation elements 92.

As may be seen in FIGS. 3 and 4, impeller 100 defines an axial direction A, a radial direction R, and a circumferential direction C. Impeller 100 is also configured for rotation about an axis of rotation X, e.g., vertical axis V (FIG. 2). Impeller 100 includes a stamped plate 110. Stamped plate 110 may be constructed of a single unitary or integral piece of material such a stainless steel, enameled steel, aluminum, copper, or brass. Such integral construction can reduce production cost or assembly time by permitting stamped plate 110 to be produced with relatively few manufacturing steps as described in greater detail below.

Figure 5:
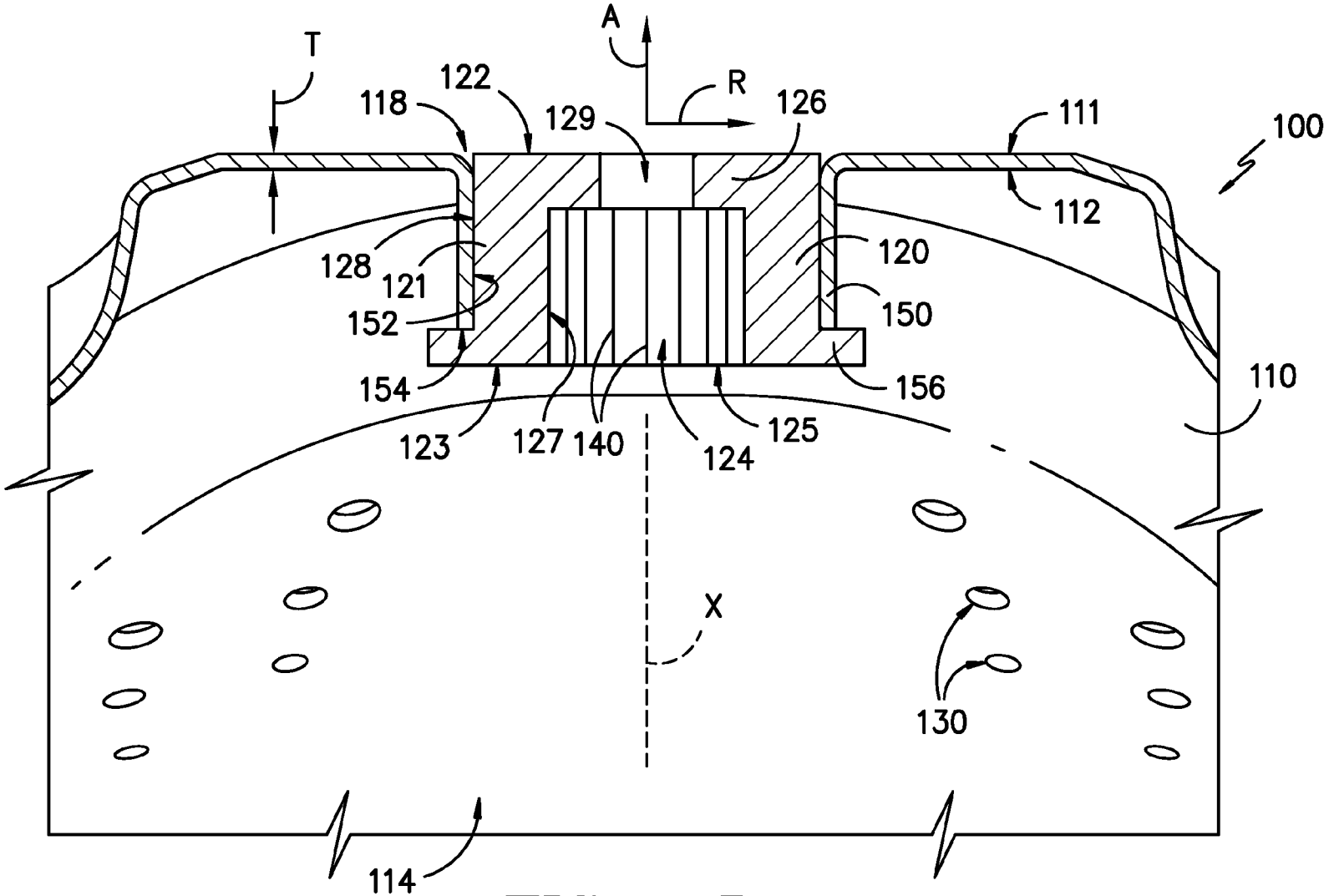
FIG. 5 is a partial, section view of the impeller of FIG. 3.

Stamped plate 110 has a top surface 111 (FIG. 3) and a bottom surface 112 (FIG. 4). Bottom surface 112 is positioned opposite top surface 111 on stamped plate 110 such that top and bottom surfaces 111 and 112 are spaced apart along the axial direction A. In particular, top surface 111 of stamped plate 110 is spaced apart from bottom surface 112 of stamped plate 110 along the axial direction A by about a thickness T (FIG. 5). Thickness T may be any suitable dimension. For example, thickness T may be less than about three-eighths of an inch, less than about one-quarter of an inch, less than about one eighth of an inch, less than about one sixteenth of an inch, or less than about one thirty-seconds of an inch.

As may be seen in FIGS. 3 and 4, stamped plate 110 is substantially circular, e.g., in a plane that is perpendicular to the axial direction A. Thus, a circumferential face 119 of stamped plate 110 may be positioned adjacent wash basket 70 (FIG. 2) when impeller 100 is mounted at bottom 80 of wash basket 70, e.g., to hinder clothing articles from gathering beneath impeller 100 or between circumferential face 119 of stamped plate 110 and wash basket 70.

Stamped plate 110 also has a plurality of agitators 116, e.g., two, three, four, five, or more agitators. Plurality of agitators 116 extend longitudinally along the radial direction Ron top surface 111 of stamped plate 110 and also project away from top surface 111 of stamped plate 110 along the axial direction A. In particular, plurality of agitators 116 project away from top surface 111 of stamped plate 110 along the axial direction A by about a distance D. Distance D may be any suitable dimension. For example, distance D may be greater than about one half of an inch, greater than about one inch, or greater than about two inches. In the exemplary embodiment shown in FIG. 3, distance D of plurality of agitators 116 is substantially constant along the radial direction R. However, in alternative exemplary embodiments, distance D may decrease or increase along the radial direction R such that plurality of agitators 116 is tapered along the radial direction R.

Stamped plate 110 also defines an opening 118 at axis of rotation X. Opening 118 extends along the axial direction A between top surface 111 and bottom surface 112. Stamped plate 110 further defines a plurality of passages 130 that extend between top surface 111 and bottom surface 112 of stamped plate 110. Plurality of passages 130 can permit wash fluid to flow through stamped plate 110, e.g., during operation of washing machine appliance 50 (FIG. 2). In the exemplary embodiment shown in FIG. 3, plurality of passages 130 is dispersed along the radial direction R on top surface 111 of stamped plate 110. However, in alternative exemplary embodiments, plurality of passages 130 may be dispersed in any suitable manner, e.g., uniformly along the circumferential direction C and/or radial direction R.

As may be seen in FIG. 4, bottom surface 112 of stamped plate 110 defines a chamber 114. As will be understood by those skilled in the art, chamber 114 of stamped plate 110 may be at least partially filled with a sound damping material (not shown) such as a closed cell polyurethane foam. In particular, a portion of chamber 114 at or beneath plurality of agitators 116 may be filled with sound damping material. Such sound dampening material can reduce operation noise of impeller 100 and/or washing machine appliance 50.

Impeller 100 also includes a mounting insert 120, e.g., for coupling impeller 100 to motor 94 or motor output shaft 98 of washing machine appliance 50 (FIG. 2). Mounting insert 120 is received within opening 118 of stamped plate 110 in order to fix mounting insert 120 to stamped plate 110. Thus, mounting insert 120 is hindered from rotating within opening 118 relative to stamped plate 110, e.g., due to friction between stamped plate 110 and mounting insert 120.

As discussed above, stamped plate 110 is constructed of a unitary or integral piece of material such as stainless steel and mounting insert 120 is received within opening 118 of stamped plate 110 in order to permit coupling of impeller 100 to washing machine appliance 50. Thus, impeller 100 is a relatively simple assembly that can be constructed from just two components. Such simple construction can decrease a production cost or an assembly time for impeller 100 and/or washing machine appliance 50. For example, impeller 100 can be produced by: (1) providing a sheet of material such as stainless steel; (2) stamping the sheet of material in order to form stamped plate 110 with plurality of agitators 116 and/or plurality of passages 130; (3) rolling edges of stamped plate 110, e.g., to form stamped plate 110 into a circular component; (4) punching opening 118 on stamped plate 110; and (5) fixing mounting insert 120 within opening 118 of stamped plate 110, e.g., press fitting mounting insert 120 within opening 118.

FIG. 5 is a partial, section view of impeller 100 showing mounting insert 120 received within opening 118 of stamped plate 110. Mounting insert 120 has an upper surface 122 and a lower surface 123 that are spaced apart along the axial direction A. A sidewall 121 extends between and connects upper surface 122 and lower surface 123. Mounting insert 120 also includes a top wall 126 that defines a hole 129.

Sidewall 121 of mounting insert 120 is received within opening 118 of stamped plate 110 in order to fix mounting insert 120 to stamped plate 110. In particular, an outer surface 128 of sidewall 121 is positioned on an inner surface 152 of a rim wall 150 of stamped plate 110. Further, sidewall 121 of mounting insert 120 may have a larger diameter than opening 118 of stamped plate 110. Thus, mounting insert 120 may be press-fit within opening 118 such that friction between outer surface 128 of sidewall 121 and inner surface 152 of rim wall 150 hinders mounting insert 120 from rotating within and/or sliding out of opening 118.

Mounting insert 120 also includes a flange 156 that is positioned away from top wall 126, e.g., along the axial direction A. Sidewall 121 extends between and connects flange 156 and top wall 126. Flange 156 has a larger diameter than opening 118 and sidewall 121 such that flange 156 does not fit within opening 118. Thus, during insertion or press fitting of mounting insert 120 within opening 118, flange 156 can hinder over insertion of mounting insert 120 into opening 118. In particular, flange 156 can impact and be positioned adjacent a distal portion 154 of rim wall 150 during insertion of mounting insert 120, e.g., in order to properly position mounting insert 120 within opening 118.

Mounting insert 120 also defines a cavity 124. In particular, an inner surface 127 of sidewall 121 may define cavity 124. Mounting insert 120 further defines an inlet 125 on lower surface 123 of mounting insert 120. Inlet 125 provides access to cavity 124 of mounting insert 120. As an example, motor output shaft 98 (FIG. 2) may be inserted into cavity 124 through inlet 125 in order to couple impeller 100 to motor 94.

To assist such coupling, mounting insert 120 includes a plurality of projections 140 mounted within cavity 124 of mounting insert 120. In particular, e.g., plurality of projections 140 are mounted on inner surface 127 of sidewall 121 and extending away from inner surface 127 of sidewall 121, e.g., along the radial direction R. As may be seen in FIG. 4, cavity 124 of mounting insert 120 has a star cross-section in a plane that is perpendicular to the axial direction A, e.g., due to plurality of projections 140. Plurality of projections 140 can engage motor output shaft 98 to assist with coupling impeller 100 to motor 94. Further, a fastener (not shown) may be inserted through top wall 126 via hole 129 into motor output shaft 98 to assist with coupling impeller 100 to motor 94.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An impeller for a washing machine appliance, the impeller having an axis of rotation about which the impeller is rotatable, the impeller defining an axial direction and a radial direction, the impeller comprising:

a stamped plate having a top surface and a bottom surface, the top surface positioned opposite the bottom surface, said stamped plate having a plurality of agitators that extend longitudinally along the radial direction and also project away from the top surface of said stamped plate along the axial direction, said stamped plate also defining an opening at the axis of rotation;

a mounting insert having an upper surface, a lower surface, and a sidewall that extends between the upper surface and the lower surface, the sidewall of said mounting insert received within the opening of said stamped plate in order to fix said mounting insert to said stamped plate, said mounting insert defining a cavity, said mounting insert also defining an inlet on the lower surface of said mounting insert that provides access to the cavity of said mounting insert; and wherein the bottom surface of said stamped plate defines a chamber, said chamber at least partially filled with a sound damping foam.

2. The impeller of claim 1, wherein said stamped plate defines a plurality of passages that extend between the top surface of said stamped plate and the bottom surface of said stamped plate.

3. The impeller of claim 2, wherein the plurality of passages is dispersed along the radial direction on the top surface of said stamped plate.

4. The impeller of claim 1, wherein the plurality of agitators project away from the top surface of said stamped plate along the axial direction by about a distance, the distance being greater than about one inch.

5. The impeller of claim 1, wherein the top surface of said stamped plate is spaced apart from the bottom surface of said stamped plate along the axial. direction by about a thickness, the thickness being less than about one quarter of an inch.

6. The impeller of claim 1, wherein said stamped plate is substantially circular in a plane that is perpendicular to the axial direction.

7. The impeller of claim 1, wherein said mounting insert comprises a plurality of projections mounted within the cavity of said mounting insert.

8. The impeller of claim 1, wherein the cavity of said mounting insert has a star cross-section in a plane that is perpendicular to the axial direction.

9. A vertical axis washing machine appliance comprising:

a cabinet, a wash tub received within said cabinet;

a wash basket rotatably mounted within said wash tub, said wash basket extending between a top portion and a bottom portion; and an impeller mounted within said wash basket adjacent the bottom portion of said wash basket, said impeller rotatable about an axis of rotation relative to said wash tub and said wash basket, said impeller defining an axial direction and a radial direction, said impeller comprising:

a stamped plate having a top surface and a bottom surface, the top surface positioned opposite the bottom surface, said stamped plate having a plurality of agitators that extend longitudinally along the radial direction and also project away from the top surface of said stamped plate along the axial direction, said stamped plate also defining an opening at the axis of rotation;

a mounting insert having an upper surface, a lower surface, and a sidewall that extends between the upper surface and the lower surface, the sidewall of said mounting insert received within the opening of said stamped plate in order to fix said mounting insert to said stamped plate, said mounting insert defining a cavity, said mounting insert also defining an inlet on the lower surface of said mounting insert that provides access to the cavity of said mounting insert; and wherein the bottom surface of said stamped plate defines a chamber, said chamber at least partially filled with a sound damaging foam.

10. The vertical axis washing machine appliance of claim 9, wherein the plurality of agitators project away from the top surface of said stamped plate along the axial direction by about a distance, the distance being greater than about one inch.

11. The vertical axis washing machine appliance of claim 9, wherein the top surface of said stamped plate is spaced apart from the bottom surface of said stamped plate along the axial direction by about a thickness, the thickness being less than about one quarter of an inch.

12. The vertical axis washing machine appliance of claim 9, wherein said mounting insert comprises a plurality of projections mounted within the cavity of said mounting insert.

13. The vertical axis washing machine appliance of claim 12, further comprising a motor having a shaft, wherein said mounting insert comprises a plurality of projections mounted within the cavity of said mounting insert, the plurality of projections engaging the shaft of said motor in order to couple said impeller to said motor.

14. The vertical axis washing machine appliance of claim 9, wherein the cavity of said mounting insert has a star cross-section in a plane that is perpendicular to the axial direction.

* * * * *